US009404339B2

(12) United States Patent
Dykstra et al.

(10) Patent No.: US 9,404,339 B2
(45) Date of Patent: Aug. 2, 2016

(54) FLOW-AFFECTING DEVICE

(75) Inventors: Jason D. Dykstra, Carrollton, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 505 days.

(21) Appl. No.: 13/704,000

(22) PCT Filed: Dec. 21, 2011

(86) PCT No.: PCT/US2011/066424

§ 371 (c)(1),
(2), (4) Date: Dec. 13, 2012

(87) PCT Pub. No.: WO2013/095423

PCT Pub. Date: Jun. 27, 2013

(65) Prior Publication Data

US 2013/0160990 A1 Jun. 27, 2013

(51) Int. Cl.
*E21B 34/06* (2006.01)
*E21B 34/08* (2006.01)

(52) U.S. Cl.
CPC ..... *E21B 34/06* (2013.01); *E21B 34/08* (2013.01)

(58) Field of Classification Search
CPC ..... E21B 34/06; E21B 34/08; E21B 43/08; E21B 43/12; E21B 43/14; E21B 43/32
USPC ..... 166/316, 233, 319, 328
See application file for complete search history.

(56) References Cited

U.S. PATENT DOCUMENTS

| | | | | |
|---|---|---|---|---|
| 3,586,104 | A | 6/1971 | Hyde | |
| 3,712,321 | A * | 1/1973 | Bauer | 137/812 |
| 3,754,576 | A * | 8/1973 | Zetterstrom et al. | 137/829 |
| 4,557,295 | A * | 12/1985 | Holmes | 137/813 |
| 4,895,582 | A * | 1/1990 | Bielefeldt | 55/337 |
| 6,283,148 | B1 | 9/2001 | Spears et al. | |
| 6,371,210 | B1 * | 4/2002 | Bode et al. | 166/370 |
| 2008/0041580 | A1 * | 2/2008 | Freyer et al. | 166/193 |

(Continued)

FOREIGN PATENT DOCUMENTS

| | | |
|---|---|---|
| CN | 101522916 | 9/2009 |
| CN | 102268978 | 12/2011 |

(Continued)

OTHER PUBLICATIONS

International Patent Application No. PCT/US2011/066424, "International Search Report and Written Opinion", Sep. 24, 2012, 9 pages.

(Continued)

*Primary Examiner* — Taras P Bemko
(74) *Attorney, Agent, or Firm* — Kilpatrick Townsend & Stockton LLP

(57) ABSTRACT

Fluid flow influencer devices in chambers subsequent to vortex assemblies are described. A flow-affecting device can move from a first position to a second position based on a flow path of fluid flowing from the vortex assembly to the chamber. The flow path may depend on an amount of rotation of the fluid from the vortex assembly. The flow-affecting device in the first position can substantially allow fluid to flow through a chamber exit opening. The flow-affecting device in the second position can substantially restrict fluid from flowing through the chamber exit opening.

20 Claims, 8 Drawing Sheets

(56) References Cited

U.S. PATENT DOCUMENTS

| | | | | |
|---|---|---|---|---|
| 2009/0000787 | A1* | 1/2009 | Hill | E21B 43/08 166/344 |
| 2011/0073306 | A1 | 3/2011 | Morrison | |
| 2011/0186300 | A1 | 8/2011 | Dykstra et al. | |
| 2011/0297385 | A1 | 12/2011 | Dykstra et al. | |

FOREIGN PATENT DOCUMENTS

| | | |
|---|---|---|
| WO | 2010053378 | 5/2010 |
| WO | 2010087719 | 8/2010 |
| WO | 2011022210 | 2/2011 |
| WO | 2011095512 | 8/2011 |
| WO | 2011115494 | 9/2011 |

OTHER PUBLICATIONS

Australian Application No. 2011383623, First Examination Report mailed on May 5, 2015, 3 pages.

Chinese Application No. 201180075673.8, Office Action mailed on Jul. 3, 2015, 20 pages. (9 pages of Office Action and 11 pages of English translation).

European Application No. 11877832.3, Extended European Search Report mailed on Oct. 14, 2015, 4 pages.

Chinese Application No. 201180075673.8, Office Action mailed on Mar. 9, 2016, 19 pages (8 pages of Original document and 11 pages of English Translation).

* cited by examiner

FLOW-AFFECTING DEVICE

CROSS-REFERENCE TO RELATED APPLICATIONS

This application is a U.S. national phase patent application under 35 U.S.C. 371 of International Patent Application No. PCT/US2011/066424 entitled "Flow-Affecting Device," filed Dec. 21, 2011, the entirety of which is incorporated herein by reference.

TECHNICAL FIELD OF THE INVENTION

The present invention relates generally to devices for impeding fluid flow in a bore in a subterranean formation in and, more particularly (although not necessarily exclusively), to devices that are capable of impeding fluid flow in a path subsequent to a autonomous valve and/or vortex assembly, based on a direction of fluid flow into the path.

BACKGROUND

Various devices can be installed in a well traversing a hydrocarbon-bearing subterranean formation. Some devices control the flow rate of fluid between the formation and tubing, such as production or injection tubing. An example of these devices is an autonomous valve that can select fluid, or otherwise control the flow rate of various fluids into the tubing.

An autonomous valve can select between desired and undesired fluids based on relative viscosity of the fluids. For example, fluid having a higher concentration of undesired fluids (e.g. water and natural gas) may have a certain viscosity in response to which the autonomous valve directs the undesired fluid in a direction to restrict the flow rate of the undesired fluid into tubing. The autonomous valve may include a flow ratio control assembly and a vortex assembly usable to select fluid based on viscosity. The flow ratio control assembly can include two passageways. Each passageway can include narrowed tubes that are configured to restrict fluid flow based on viscosity of the fluid. For example, one tube in the first passageway may be narrower than the second tube in the second passageway, and configured to restrict fluid having a certain relative viscosity more than fluid having a different relative viscosity. The second tube may offer relatively constant resistance to fluid, regardless of the viscosity of the fluid.

Fluid entering the vortex assembly via a first passageway, such as a passageway that is tangential to the vortex assembly, may be caused to rotate in the vortex assembly and restricted from exiting an exit opening in the vortex assembly. Fluid entering the vortex assembly via a second passageway, such as a passageway that is radial to the vortex assembly, may be allowed to exit through the exit opening without any, or much, restriction.

Although this autonomous valve is very effective in meeting desired fluid selection downhole, devices that can provide additional fluid flow control and/or selection are desirable.

SUMMARY

Certain aspects and embodiments of the present invention are directed to flow-affecting devices that can respond to direction of fluid flow.

One aspect relates to an assembly that can be disposed in a wellbore. The assembly includes a chamber and a flow-affecting device in the chamber. The chamber can be subsequent to an exit opening of a vortex assembly. The flow-affecting device can move between a first position and a second position based on an amount of rotation of fluid entering the chamber from the vortex assembly.

Another aspect relates to an assembly that includes a vortex assembly and a flow-affecting device. The vortex assembly includes an exit opening. The flow-affecting device is in a chamber that is in fluid communication with the exit opening. The flow-affecting device can impede fluid flow to a chamber exit opening by an amount that depends on a direction of flow of the fluid entering the chamber through the exit opening.

Another aspect relates to an assembly that includes a chamber and a flow-affecting device in the chamber. The chamber can be positioned subsequent to a flow path of an exit opening of a vortex assembly. The chamber includes a chamber exit opening. The flow-affecting device can substantially allow fluid having a first flow path into the chamber from the exit opening to flow through the chamber exit opening and can substantially restrict fluid having a second flow path into the chamber from the exit opening from flowing through the chamber exit opening.

These illustrative aspects are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
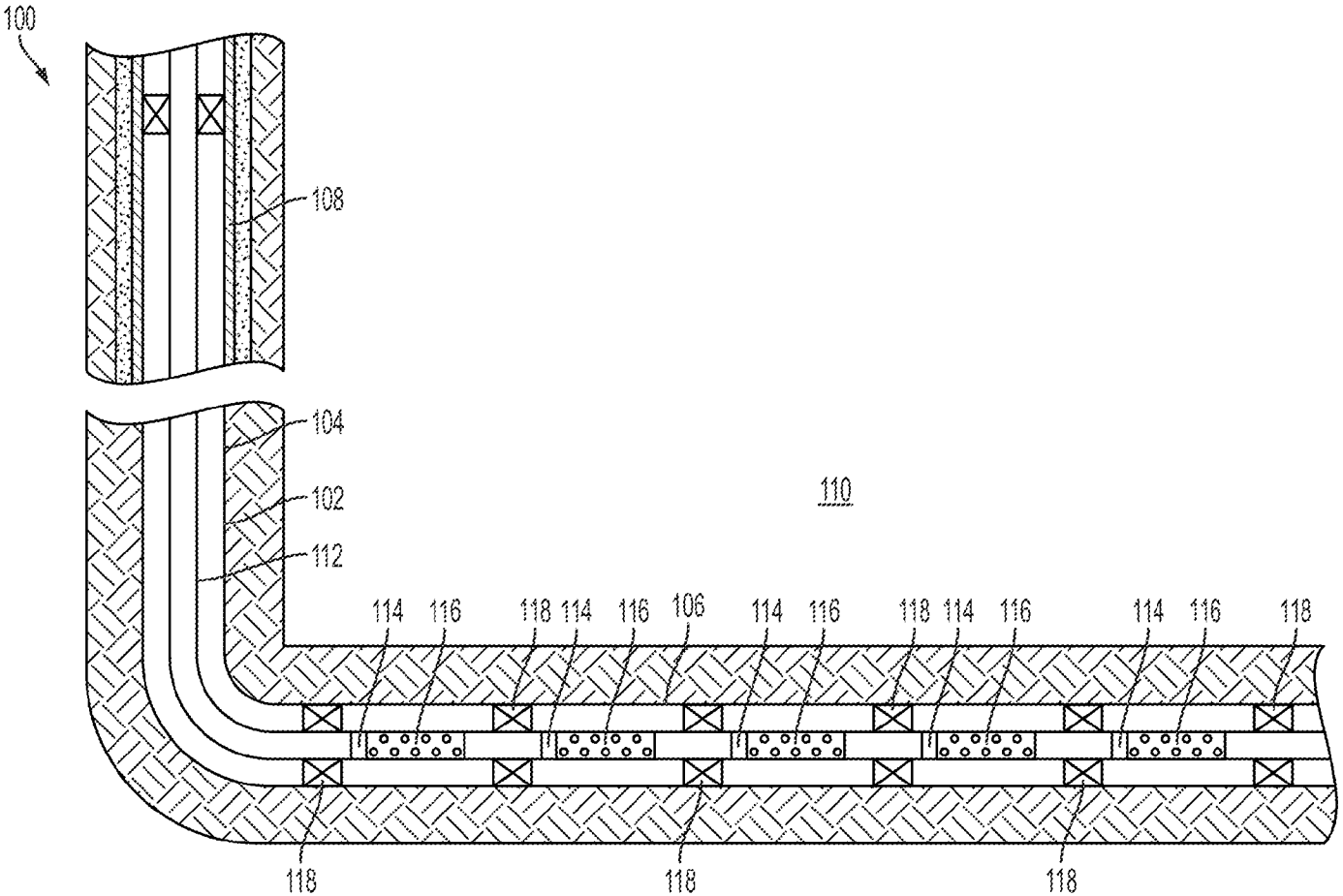
FIG. 1 is a schematic illustration of a well system having chambers with flow-affecting devices subsequent to autonomous valves according to one embodiment of the present invention.

Certain aspects and embodiments relate to a flow-affecting device in a chamber that is subsequent to an exit opening of an autonomous valve, such as an exit opening of a vortex assembly in an autonomous valve. The flow-affecting device can move from a first position to a second position based on a flow path of fluid flowing from the vortex assembly to the chamber. The flow path may depend on an amount of rotation of the fluid from the vortex assembly. The flow-affecting device in the first position can substantially allow fluid to flow through a chamber exit opening. The flow-affecting device in the second position can substantially restrict fluid from flowing through the chamber exit opening.

In some embodiments, substantially allowing fluid to flow through the chamber exit opening may include allowing a majority of the fluid to flow through the chamber exit opening. Substantially restricting fluid from flowing through the chamber exit opening may include preventing at least a majority of the fluid from flowing through the chamber exit opening at least for a certain length of time.

For example, a vortex assembly may cause fluid having a certain property to rotate in the vortex assembly, and the fluid continues to rotate as it exits in the vortex assembly into the chamber that includes the flow-affecting device. The flow-affecting device may be configured to respond to the rotating fluid by being in a certain position. Depending on a configuration of the flow-affecting device with respect to an exit opening in the chamber, the flow-affecting device in the certain position can substantially restrict fluid from exiting through the exit opening in the chamber or can substantially allow fluid to exit through the exit opening in the chamber. A vortex assembly may cause fluid having a certain other property to exit to the chamber that includes the flow-affecting device without, or without much, fluid rotation. The flow-affecting device may be configured to respond to the fluid flowing into the chamber without, or without much, fluid rotation by being in a certain other position at which, depending on the configuration of the flow-affecting device with respect to the exit opening in the chamber, the flow-affecting device can substantially allow fluid to, or substantially restrict fluid from, flowing through the exit opening in the chamber.

In some embodiments, fluid rotation is configured to actuate the flow-affecting device to, in conjunction for example with an autonomous valve, reduce production of unwanted fluid.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 depicts a well system 100 with chambers having flow-affecting devices according to certain embodiments of the present invention subsequent to autonomous valves. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Flow control devices 114 and production tubular sections 116 in various production intervals adjacent to the formation 110 are positioned in the tubing string 112. Each of the flow control devices 114 can include an autonomous valve capable of selectively causing fluid having a certain property to rotate and can include a chamber with a flow-affecting device.

On each side of each production tubular section 116 is a packer 118 that can provide a fluid seal between the tubing string 112 and the wall of the wellbore 102. Each pair of adjacent packers 118 can define a production interval.

Each of the production tubular sections 116 can provide sand control capability. Sand control screen elements or filter media associated with production tubular sections 116 can allow fluids to flow through the elements or filter media, but prevent particulate matter of sufficient size from flowing through the elements or filter media. In some embodiments, a sand control screen may be provided that includes a non-perforated base pipe having a wire wrapped around ribs positioned circumferentially around the base pipe. A protective outer shroud that includes perforations can be positioned around an exterior of a filter medium.

Flow control devices 114 can allow for control over the volume and composition of produced fluids. For example, flow control devices 114 may autonomously restrict or resist production of formation fluid from a production interval in which undesired fluid, such as water or natural gas for an oil production operation, is entering. "Natural gas" as used herein means a mixture of hydrocarbons (and varying quantities of non-hydrocarbons) that exists in a gaseous phase at room temperature and pressure and in a liquid phase and/or gaseous phase in a downhole environment.

Formation fluid flowing into a production tubular section 116 may include more than one type of fluid, such as natural gas, oil, water, steam and carbon dioxide. Steam and carbon dioxide may be used as injection fluids to cause hydrocarbon fluid to flow toward a production tubular section 116. Natural gas, oil and water may be found in the formation 110. The proportion of these types of fluids flowing into a production tubular section 116 can vary over time and be based at least in part on conditions within the formation and the wellbore 102. A flow control device 114 according to some embodiments can reduce or restrict production from an interval in which fluid having a higher proportion of undesired fluids.

When a production interval produces a greater proportion of undesired fluids, a flow control device 114 in that interval can restrict or resist production from that interval. Other production intervals producing a greater proportion of desired fluid, can contribute more to the production stream entering tubing string 112. For example, the flow control device 114 can include the flow-affecting device that can control fluid flow rate based on a rotation of the fluid entering the chamber.

Although FIG. 1 depicts flow control devices 114 positioned in the substantially horizontal section 106, flow control devices 114 (and production tubular sections 116) according to various embodiments of the present invention can be located, additionally or alternatively, in the substantially vertical section 104. Furthermore, any number of flow control devices 114, including one, can be used in the well system 100 generally or in each production interval. In some embodiments, flow control devices 114 can be disposed in simpler wellbores, such as wellbores having only a substantially vertical section. Flow control devices 114 can be disposed in open hole environments, such as is depicted in FIG. 1, or in cased wells.

Figure 2:
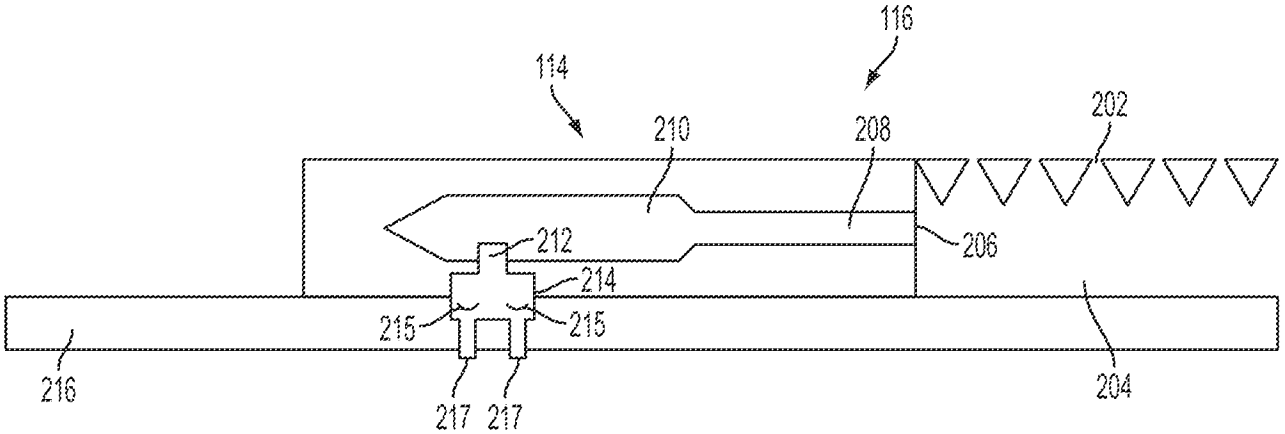
FIG. 2 is a cross-sectional side view of a chamber and flow-affecting devices subsequent to a flow path of an autonomous valve according to one embodiment of the present invention.

FIG. 2 depicts a cross-sectional side view of a production tubular section 116 that includes a flow control device 114 and a screen assembly 202. The production tubular defines an interior passageway 204, which may be an annular space. Formation fluid can enter the interior passageway 204 from the formation through screen assembly 202, which can filter the fluid. Formation fluid can enter the flow control device 114 from the interior passageway through an inlet 206 to a flow path 208 of a vortex assembly 210. Subsequent to an exit opening 212 of the vortex assembly 210 is a chamber 214 that includes flow-affecting devices 215. In addition to the vortex assembly 210, the flow-affecting devices 215 can restrict or allow fluid to flow through chamber exit openings 217.

Chambers according to various embodiments of the present invention may be any configuration, and include one, two, or more than two exit openings. Flow-affecting devices according to various embodiments of the present invention can include any configuration, and may be coupled to the chamber, another component or free floating. Examples of flow-affecting devices include, but are not limited to, flappers, washers, discs, and spheroids. FIGS. 3-16 depict chambers and flow-affecting devices according to some embodiments of the invention.

Figure 3:
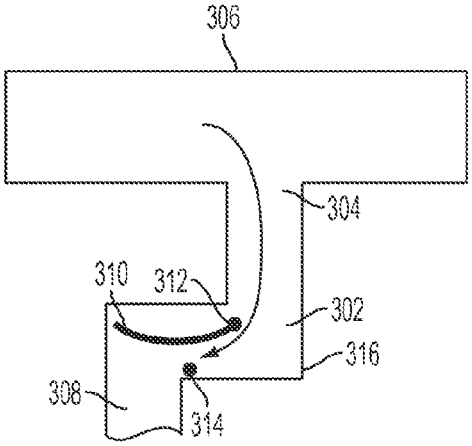
FIG. 3 is a cross-sectional side view of a flow-affecting device that is a flapper in a chamber and in an open position according to one embodiment of the present invention.
Figure 4:
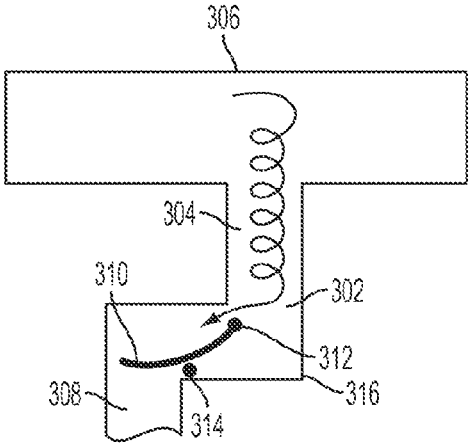
FIG. 4 shows the flow-affecting device of FIG. 3 in a closed position according to one embodiment of the present invention.

FIGS. 3-4 depict a chamber 302 in a flow path subsequent to an exit opening 304 of a vortex assembly 306. The chamber 302 includes a chamber exit opening 308 and a flow-affecting device that is a flapper 310. The flapper 310 may be coupled to the chamber 302, such as via a pivot 312, and can be configured to move position in response to a direction of flow of fluid into the chamber 302 through the exit opening 304. In other embodiments, the flapper 310 is coupled to the chamber 302 via a spring.

The chamber 302 includes a protrusion 314 position proximate the chamber exit opening 308. The protrusion 314 can prevent the flapper 310 in a closed position from completely sealing the chamber exit opening 308 so that the flapper 310 can return to an open position. In other embodiments, the protrusion 314 is coupled to the flapper 310 instead of to the chamber. In still other embodiments, the protrusion 314 is absent.

Flapper 310 may be made from any suitable material. In some embodiments, the flapper 310 is made from an erosion-resistant material. Examples of suitable materials include ceramics, metals, plastics, and composites. In some embodiments, the flapper 310 is a flexible member coupled to the chamber 302.

FIG. 3 depicts flapper 310 in an open position, which may be an initial position of the flapper 310 without the presence of fluid flow. The flapper 310 can be in the open position in response to fluid that is not rotating, or that is rotating by a relatively small amount (as depicted by arrows in FIG. 3), entering the chamber 302 from the exit opening 304. The flapper 310 in the open position can substantially allow fluid entering the chamber 302 from the exit opening 304 to flow to the chamber exit opening 308 and exit the chamber 302. For example, the flapper 310 may restrict some fluid flow, but allow the majority of the fluid to flow to the chamber exit opening 308. In other embodiments, flapper 310 does not restrict any fluid flow.

FIG. 4 depicts flapper 310 in a closed position. The flapper 310 can be configured to move to the closed position in response to fluid flowing from the exit opening 304 into the chamber 302 rotating by an amount that is above a certain threshold, as shown by arrows in FIG. 4. For example, the rotating fluid can cause the flapper 310 to move toward the chamber exit opening 308 to substantially restrict the fluid from flowing to the chamber exit opening 308, at least for a certain amount of time. Substantially restricting the fluid can include allowing some fluid to flow to the chamber exit opening 308, but restricting a majority of the fluid. In other embodiments, the flapper 310 restricts all of the fluid from flowing to the chamber exit opening 308 when the flapper 310 is in the closed position.

The chamber 302 in FIGS. 3-4 includes a constrained wall 316 that can direct flow of fluid, whether rotating or not, from the exit opening 304 toward the flapper 310 and the chamber exit opening 308.

Figure 5:
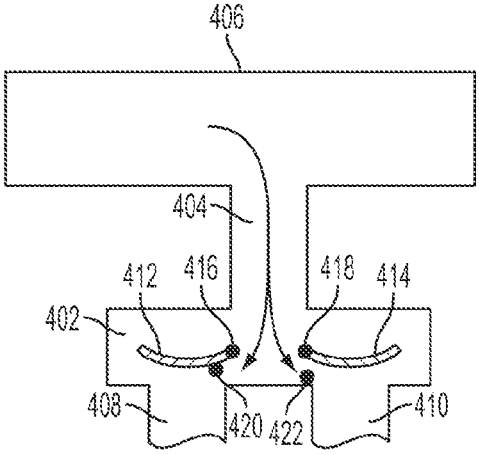
FIG. 5 is a cross-sectional side view of a chamber that includes two flow-affecting devices that are flappers in an open position according to one embodiment of the present invention.
Figure 6:
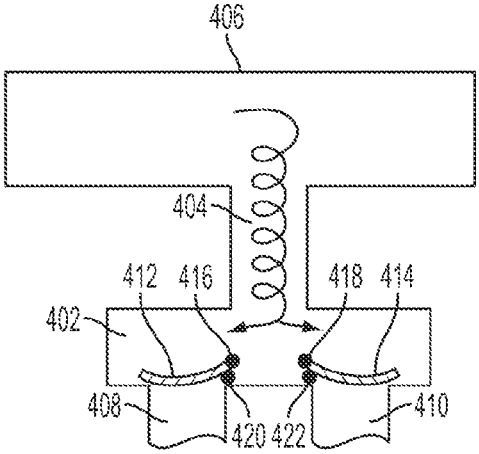
FIG. 6 shows the flow-affecting devices of FIG. 5 in a closed position according to one embodiment of the present invention.

Chambers according to other embodiments include more than one chamber exit opening. FIGS. 5-6 depict a chamber 402 in a flow path subsequent to an exit opening 404 of a vortex assembly 406. The chamber 402 includes two chamber exit openings 408, 410 and includes flow-affecting devices 412, 414 that are each flappers. Each of the flow-affecting devices 412, 414 is coupled to the chamber 402, such as via pivots 416, 418 or other mechanism.

Each of the flow-affecting devices 412, 414 can move position in response to a direction of flow of fluid into the chamber 402 through the exit opening 404. The flow-affecting devices 412, 414 are in an open position in FIG. 5 in response, for example, to fluid flowing into the chamber 402 without rotation or without rotating by an amount above a certain threshold as shown via arrows. The flow-affecting devices 412, 414 in the open position may not restrict, or may not restrict substantially, fluid flowing into the chamber 402 from exiting through chamber exit openings 408, 410. The flow-affecting devices 412, 414 are in a dosed position in FIG. 6 in response, for example, to fluid flowing into the chamber 402 having a rotation above a certain amount as shown via arrows. The flow-affecting devices 412, 414 in the closed position can substantially restrict fluid flowing into the chamber 402 from exiting through chamber exit openings 408, 410. The thresholds for amount of rotation for the open position and the close position may be the same threshold or different thresholds.

Protrusions 420, 422 may be included in the chamber 402 to prevent the flow-affecting devices 412, 414 from completely restricting fluid from flowing through chamber exit openings 408, 410 when in the closed position. Protrusion 420 is coupled to flow-affecting device 412. Protrusion 422 is coupled to an inner wall of the chamber 402 proximate the chamber exit opening 410 to prevent flow-affecting device 414 from completely restricting chamber exit opening 410. In other embodiments, the chamber 402 does not include protrusions 420, 422.

Figure 7:
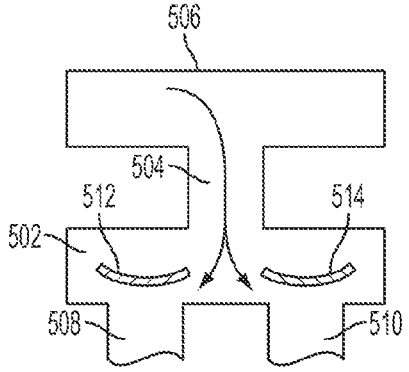
FIG. 7 is a cross-sectional side view of a chamber that includes two flow-affecting devices that are discs in an open position according to one embodiment of the present invention.
Figure 8:
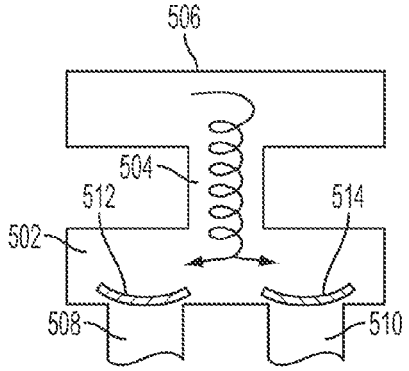
FIG. 8 shows the flow-affecting devices of FIG. 7 in a closed position according to one embodiment of the present invention.

In other embodiments, flow-affecting devices are discs. FIGS. 7-8 depict a chamber 502 in a flow path subsequent to an exit opening 504 of a vortex assembly 506. The chamber 502 includes two chamber exit openings 508, 510 and includes flow-affecting devices 512, 514 that are discs or rings. Each of the flow-affecting devices 512, 514 may float in fluid that is in the chamber 506, and are configured to move position in response to a direction of flow of fluid into the chamber 502 through exit opening 504.

The flow-affecting devices 512, 514 are in an open position in FIG. 7 in response, for example, to fluid flowing into the chamber 502 without rotation or without rotating by an amount above a certain threshold as shown via arrows. The flow-affecting devices 512, 514 in the open position may not restrict, or may not restrict substantially, fluid flowing into the chamber 502 from exiting through chamber exit openings 508, 510. The flow-affecting devices 512, 514 are in a closed position in FIG. 8 in response, for example, to fluid flowing into the chamber 502 having a rotation above a certain amount as shown via arrows. For example, rotating fluid entering the chamber 502 as in FIG. 8 can cause the flow-affecting devices 512, 514 to move toward chamber exit openings 508, 510 and restrict fluid flow to the chamber exit openings 508, 510. The flow-affecting devices 512, 514 in the closed position can substantially restrict fluid flowing into the chamber 502 from exiting through chamber exit openings 508, 510. The flow-affecting devices 512, 514 may be sized based on expected flow rates, and expected flow properties. For example, the flow-affecting devices 512, 514 may have a larger thickness to increase a threshold of fluid rotation at which the flow-affecting devices 512, 514 move to the closed position.

Flow-affecting devices 512, 514 according to some embodiments may each include an inner opening that can prevent the flow-affecting devices 512, 514 from completely restricting flow to the chamber exit openings 508, 510 when the flow-affecting devices 512, 514 are in the closed position.

In other embodiments, protrusions (not shown) may be included in the chamber 502 and coupled to flow-affecting devices 512, 514 or an inner wall of the chamber 502. Protrusions may prevent the flow-affecting devices 512, 514 from completely restricting fluid from flowing to chamber exit openings 508, 510. In other embodiments, the chamber 502 does not include protrusions or openings in the flow-affecting devices 512, 514.

Although FIGS. 7-8 depict two flow-affecting devices 512, 514 and two chamber exit openings 508, 510, one flow-affecting device and/or one chamber exit opening can be used. Moreover, more than two of each component can be used.

Figure 9:
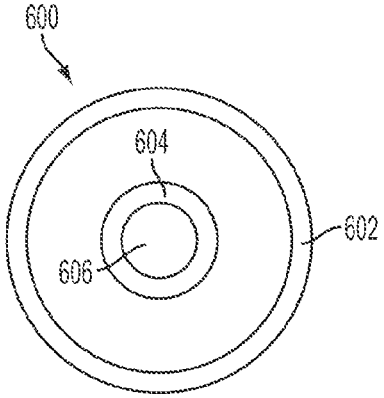
FIG. 9 is a top view of a flow-affecting device that is a disc according to one embodiment of the present invention.

FIG. 9 depicts a cross-sectional view of a flow-affecting device 600 that is a disc or ring, and that may be suitable for use in the embodiments shown in FIGS. 7-8. The flow-affecting device 600 includes an outer edge 602, which may be a lip, and an inner edge 604 defining an inner opening 606. The outer edge 602 may be sized depending on desired restriction performance in response to amount of fluid rotation. The inner opening 606 may prevent the flow-affecting device 600 from completely restricting fluid from flowing to a chamber exit opening when the flow-affecting device 600 is in a closed position.

Figure 10:
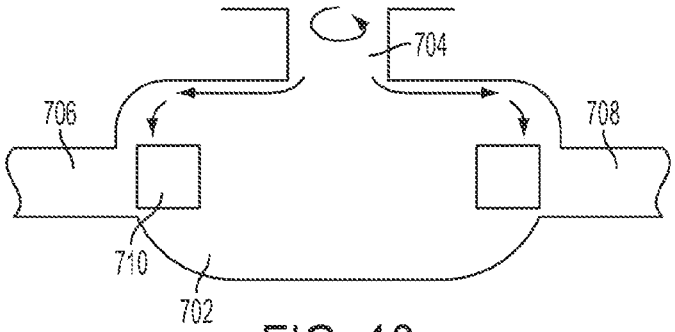
FIG. 10 is a cross-sectional side view of a chamber that includes a flow-affecting device that is a washer in a closed position according to one embodiment of the present invention.
Figure 11:
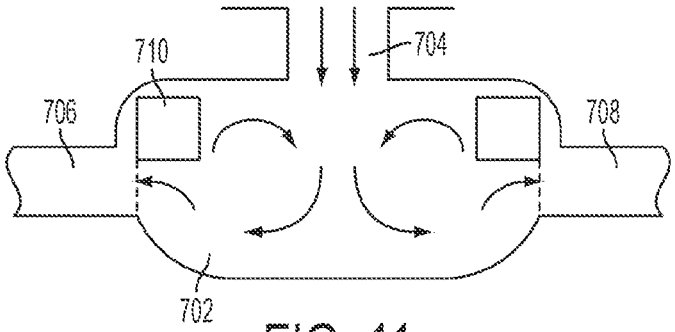
FIG. 11 shows the flow-affecting device of FIG. 10 in an open position according to one embodiment of the present invention.
Figure 12:
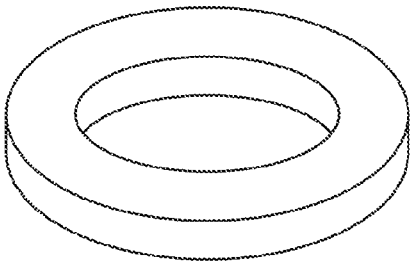
FIG. 12 is a perspective view of a flow-affecting device that is a washer according to one embodiment of the present invention.

In some embodiments, flow-affecting devices are washers. FIGS. 10-11 depict a chamber 702 in a flow path subsequent to an exit opening 704 of a vortex assembly (not shown). The chamber 702 includes two chamber exit openings 706, 708 and includes a flow-affecting device 710 that is a washer. FIG. 12 depicts a perspective view of an example of a washer. The flow-affecting device 710 may be floating in fluid in the chamber 702 or may be coupled to the chamber 702. The flow-affecting device 710 can move position in response to a direction of flow of fluid into the chamber 702 through exit opening 704.

FIGS. 10-11 depict chamber exit openings 706, 708 located on sides of the chamber 702. In other embodiments, the chamber exit openings 706, 708 can be located on a bottom of the chamber 702, relative to the exit opening 704. Furthermore, other embodiments described above may be configured with chamber exit openings on one or more sides of a chamber.

The flow-affecting device 710 is in a closed position in FIG. 10 in response, for example, to fluid flowing into the chamber 702 that is rotating by an amount above a certain threshold, as shown by arrows in FIG. 10. The closed position may be an initial position of the flow-affecting device 710. The flow-affecting device 710 in the closed position may substantially restrict fluid from flowing to chamber exit openings 706, 708. In some embodiments, the flow-affecting device 710 includes one or more protrusions (not shown) to prevent the flow-affecting device 710 from completely restricting fluid flow to the chamber exit openings 706, 708 when the flow-affecting device 710 is in the closed position.

The flow-affecting device 710 is in an open position in FIG. 11 in response, for example, to fluid flowing into the chamber 702 without rotating, or without rotating by an amount that is above a certain threshold, as shown by arrows in FIG. 11. For example, fluid can flow into the chamber 702, be guided by a bottom wall of the chamber 702 to flow toward the flow-affecting device 710, and exert a force on the flow-affecting device 710 to cause the flow-affecting device 710 to move to the open position.

Although FIGS. 10-11 depict two chamber exit openings 706, 708, one chamber exit opening can be used. Moreover, more than two chamber exit openings can be used.

Figure 13:
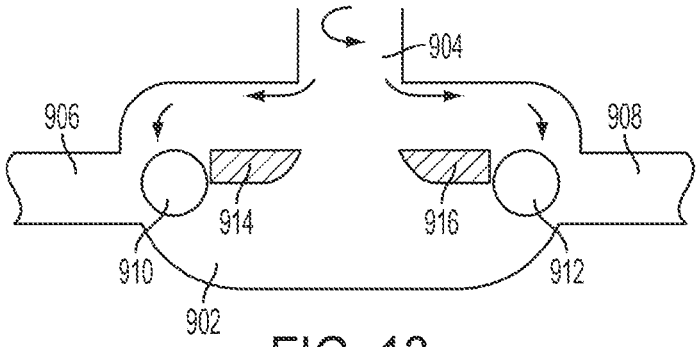
FIG. 13 is a cross-sectional side view of a chamber that includes flow diverters and flow-affecting devices that are spheroids in a closed position according to one embodiment of the present invention.
Figure 14:
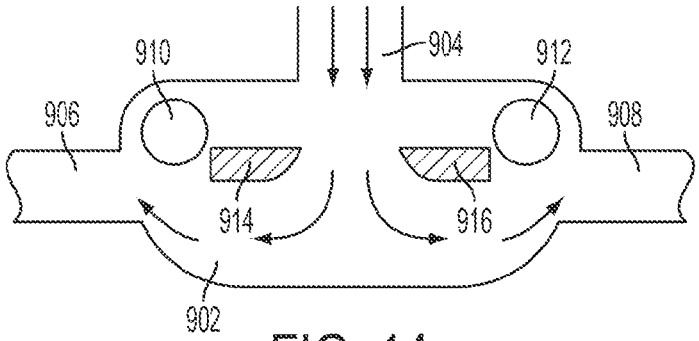
FIG. 14 shows the flow-affecting devices of FIG. 13 in an open position according to one embodiment of the present invention.

Flow-affecting devices according to some embodiments may be discrete component instead of one washer component. FIGS. 13-14 depict a chamber 902 in a flow path subsequent to an exit opening 904 of a vortex assembly (not shown). The chamber 902 includes two chamber exit openings 906, 908 on sides of the chamber 902, flow-affecting devices 910, 912 that are spheroids, and flow diverters 914, 916. Although spheroids are shown, flow-affecting devices 910, 912 may be components of any suitable shape.

Flow diverters 914, 916 may be coupled to the chamber 902 in a fixed position and be configured to differentiate flow between flow paths—e.g., substantially rotating flow path and a substantially non-rotating flow path.

The flow-affecting devices 910, 912 may float in fluid in the chamber 902. The flow-affecting devices 910, 912 can move position in response to a direction of flow of fluid into the chamber 902 through exit opening 904.

The flow-affecting devices 910, 912 are in a closed position in FIG. 13 in response, for example, to fluid flowing into the chamber 902 that is rotating by an amount above a certain threshold, as shown by arrows in FIG. 13. For example, flow diverters 914, 916 can divert rotating fluid to an upper portion of the flow-affecting devices 910, 912 such that the flow-affecting devices 910, 912 remain in or are moved to the closed position. In some embodiments, the closed position may be an initial position of the flow-affecting devices 910, 912. The flow-affecting devices 910, 912 in the closed position may substantially restrict fluid from flowing to chamber exit openings 906, 908.

The flow-affecting devices 910, 912 are in an open position in FIG. 14 in response, for example, to fluid flowing into the chamber 902 without rotating, or without rotating by an amount that is above a certain threshold, as shown by arrows in FIG. 14. For example, fluid can flow into the chamber 902, be guided by a bottom wall of the chamber 902 to flow toward a bottom portion of the flow-affecting devices 910, 912, and exert a force on the flow-affecting devices 910, 912 to cause the flow-affecting devices 910, 912 to move to the open position.

Figure 15:
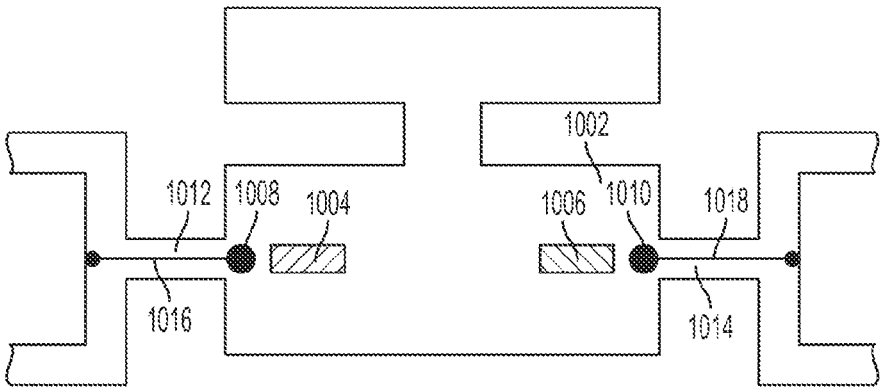
FIG. 15 is a cross-sectional side view of a chamber with flow-affecting devices that are spheroids coupled by flexible members according to one embodiment of the present invention.

In some embodiments, flow-affecting devices that are spheroids, or other suitably shaped components, can be coupled to flexible members to prevent the flow-affecting devices from completely preventing fluid from flowing to chamber exit openings. FIG. 15 depicts one embodiment of a chamber 1002 that includes flow diverters 1004, 1006 and flow-affecting devices 1008, 1010. The flow-affecting devices 1008, 1010 are coupled to walls of chamber exit openings 1012, 1014 by flexible members 1016, 1018. Flexible members 1016, 1018 may prevent flow-affecting devices 1008, 1010 from completely preventing fluid from flowing to chamber exit openings 1012, 1014 such that suction or other forces may be decoupled, allowing flow-affecting devices 1008, 1010 to return to an open position.

In some embodiments, flow-affecting devices 1008 can be configured to be in opposite positions (e.g. open and closed positions) in response to the same flow to allow for a chamber exit opening to be selected based on flow. For example, flow-affecting device 1008 can be configured to be in an open position in response to fluid flowing into the chamber 1002 without rotating above a certain threshold, and flow-affecting device 1010 is configured to be in a closed position in response to fluid that flowing into the chamber 1002 without rotating above the threshold. Flow-affecting device 1008 can be in a closed position in response to fluid flowing into the chamber 802 that is rotating above a certain threshold, and flow-affecting device 1010 can be in an open position in response to fluid flowing into the chamber that is rotating above the threshold. Flexible members 1016, 1018 can facilitate allowing flow-affecting devices 1008, 1010 to be in opposite positions based on the same fluid rotation amount.

Figure 16:
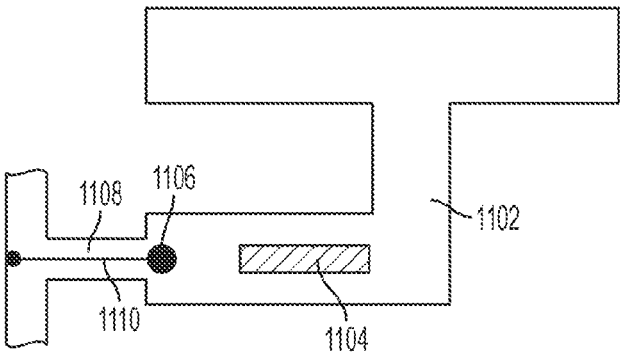
FIG. 16 is a cross-sectional side view of a chamber with a flow-affecting device that is a spheroid coupled by a flexible member according to one embodiment of the present invention.

Flow-affecting devices that are spheroids, or other suitably shaped components, may be implemented with chambers that include one opening. FIG. 16 depicts one embodiment of a chamber 1102 that includes a flow diverter 1104 and a flow-affecting device 1106 that is a spheroid coupled to a wall of a chamber exit opening 1108 via a flexible member 1110. The wall of the chamber 1102 opposite the chamber exit opening 1108 may be constrained to direct fluid flow toward the chamber exit opening 1108, flow diverter 1104 and/or flow-affecting device 1106.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly capable of being disposed in a wellbore, the assembly comprising:

a chamber that is a non-vortex-assembly chamber adapted to be positioned subsequent to an exit opening of a vortex assembly; and a flow-affecting device in the chamber, the flow-affecting device being adapted to move between a first position and a second position based on an amount of rotation of fluid entering the chamber from the vortex assembly.

2. The assembly of claim 1, wherein the chamber comprises a chamber exit opening, wherein the flow-affecting device in the first position is adapted to substantially allow fluid to exit through the chamber exit opening, and wherein the flow-affecting device in the second position is adapted to substantially restrict fluid from exiting through the chamber exit opening.

3. The assembly of claim 2, wherein the flow-affecting device is adapted to be in the second position in response to the amount of rotation of fluid entering the chamber exceeding a first threshold amount of rotation, wherein the flow-affecting device is adapted to be in the first position in response to the amount of rotation of fluid entering the chamber being below a second threshold amount of rotation.

4. The assembly of claim 2, wherein the chamber comprises a second chamber exit opening, wherein the flow-affecting device in the first position is adapted to substantially restrict fluid from exiting through the second chamber exit opening, and wherein the flow-affecting device in the second position is adapted to substantially allow fluid to exit through the second chamber exit opening.

5. The assembly of claim 1, wherein the amount of rotation of the fluid is based on a direction of flow of the fluid entering the chamber from the vortex assembly.

6. The assembly of claim 5, further comprising the vortex assembly.

7. The assembly of claim 1, wherein the flow-affecting device is adapted (i) to substantially allow fluid having a first flow path into the chamber from the exit opening to flow through a chamber exit opening and (ii) to substantially restrict fluid having a second flow path into the chamber from the exit opening from flowing through the chamber exit opening.

8. The assembly of claim 1, wherein the flow-affecting device is one of:

a flapper;

a disc;

a spheroid; or a washer.

9. The assembly of claim 8, wherein the flow-affecting device is the spheroid, the assembly further comprising:

a flow diverter in the chamber; and a flexible member coupling the spheroid to part of the chamber.

10. The assembly of claim 1, further comprising:

a protrusion coupled to one of the flow-affecting device or a wall of the chamber.

11. An assembly capable of being disposed in a wellbore, the assembly comprising:

a vortex assembly comprising an exit opening; and a flow-affecting device in a chamber that is in fluid communication with the exit opening, the flow-affecting device being adapted to impede fluid flow to a chamber exit opening by an amount that depends on an amount of rotation of the fluid entering the chamber through the exit opening, wherein the chamber is a non-vortex-assembly chamber.

12. The assembly of claim 11, wherein the flow-affecting device is adapted to move between a first position and a second position based on the amount of rotation of the fluid, wherein the flow-affecting device in the first position is adapted to substantially allow fluid to exit through the chamber exit opening, and wherein the flow-affecting device in the second position is adapted to substantially restrict fluid from exiting through the chamber exit opening.

13. The assembly of claim 11, wherein the flow-affecting device is adapted (i) to substantially allow fluid having a first flow path into the chamber from the exit opening to flow through the chamber exit opening and (ii) to substantially restrict fluid having a second flow path into the chamber from the exit opening from flowing through the chamber exit opening.

14. The assembly of claim 11, wherein the flow-affecting device is one of:

a flapper;

a disc;

a spheroid; or a washer.

15. The assembly of claim 14, wherein the flow-affecting device is the spheroid, the assembly further comprising:

a flow diverter in the chamber; and a flexible member coupling the spheroid to part of the chamber.

16. An assembly capable of being disposed in a wellbore, the assembly comprising:

a chamber that is a non-vortex-assembly chamber and is adapted to be positioned subsequent to a flow path of an exit opening of a vortex assembly, the chamber comprising a chamber exit opening; and a flow-affecting device in the chamber, the flow-affecting device being adapted (i) to substantially allow fluid having a first flow path into the chamber from the exit opening to flow through the chamber exit opening and (ii) to substantially restrict fluid having a second flow path into the chamber from the exit opening from flowing through the chamber exit opening, wherein fluid flowing in the first flow path or the second flow path is based on an amount of rotation of the fluid, and wherein the flow-affecting device is adapted to move between a first position and a second position based on the amount of rotation of the fluid.

17. The assembly of claim 16, wherein the flow-affecting device in the first position is adapted to substantially allow fluid to exit through the chamber exit opening, and wherein the flow-affecting device in the second position is adapted to substantially restrict fluid from exiting through the chamber exit opening.

18. The assembly of claim 16, further comprising the vortex assembly, wherein the fluid flows into the first flow path or the second flow path based on a direction of flow of the fluid entering the chamber from the vortex assembly.

19. The assembly of claim 18, wherein the flow-affecting device is one of:

a flapper;

a disc;

a spheroid; or a washer.

20. The assembly of claim 19, wherein the flow-affecting device is the spheroid, the assembly further comprising:

a flow diverter in the chamber; and a flexible member coupling the spheroid to part of the chamber.

* * * * *